US006973742B2

(12) United States Patent
Gordon

(10) Patent No.: US 6,973,742 B2
(45) Date of Patent: Dec. 13, 2005

(54) THERMAL FOOT COVER

(76) Inventor: Dave W. Gordon, Rte. 2, Box 180C, Haskell, OK (US) 74436

( * ) Notice: Subject to any disclaimer, the term of this patent is extended or adjusted under 35 U.S.C. 154(b) by 613 days.

(21) Appl. No.: 09/768,969

(22) Filed: Jan. 24, 2001

(65) Prior Publication Data

US 2001/0025436 A1 Oct. 4, 2001

Related U.S. Application Data

(63) Continuation of application No. 09/235,267, filed on Jan. 22, 1999, now Pat. No. 6,185,845.

(51) Int. Cl.[7] ..... A43B 3/16

(52) U.S. Cl. ..... 36/7.1; 36/9 R; 36/2.6; 36/11

(58) Field of Search ..... 36/9 R, 7.1 R, 36/2.6, 110, 54, 50.1, 45, 11

(56) References Cited

U.S. PATENT DOCUMENTS

| | | | | | |
|---|---|---|---|---|---|
| 2,398,510 | A | * | 4/1946 | Wilson | 36/45 |
| 3,373,512 | A | * | 3/1968 | Jacobson | 36/7.1 |
| 3,875,687 | A | * | 4/1975 | Henderson | 36/7.1 |
| 4,023,281 | A | * | 5/1977 | Terry | 36/7.1 R |
| 4,099,341 | A | * | 7/1978 | Gibson | 36/7.3 |
| 4,301,603 | A | * | 11/1981 | Scott | 36/110 |
| 4,376,344 | A | * | 3/1983 | Kimsey | 36/7.1 |
| 4,516,336 | A | * | 5/1985 | Nissenbaum | 36/7.1 |
| 4,538,368 | A | * | 9/1985 | Mugford | 36/112 |
| 4,658,515 | A | * | 4/1987 | Oatman | 36/2.6 |
| 4,777,740 | A | * | 10/1988 | Akagi | 36/14 |
| 4,788,780 | A | * | 12/1988 | Boggs | 36/7.1 |
| 4,887,368 | A | * | 12/1989 | Latzke | 36/43 |
| 4,896,437 | A | * | 1/1990 | Johnson | 36/1.5 |
| 4,896,438 | A | * | 1/1990 | DeBease | 36/7.1 |
| 5,150,536 | A | * | 9/1992 | Strong | 36/7.1 |
| 5,220,791 | A | * | 6/1993 | Bulzomi | 36/3 A |
| 6,185,845 | B1 | * | 2/2001 | Gordon | 36/7.1 R |

* cited by examiner

*Primary Examiner*—M. D. Patterson
(74) *Attorney, Agent, or Firm*—Frank J. Catalano

(57) ABSTRACT

The thermal foot cover is an article of footwear to be worn when the wearer's foot is subjected to cold temperatures. The thermal foot cover has an upper cover portion attached to a bottom panel to define a cavity for insertion of a wearer's shoe-encased or boot-encased foot or a wearer's foot. The upper cover portion and the bottom panel are made from a material comprising an outer covering, a radiant barrier and a inner covering where the radiant barrier is sandwiched between the outer cover and the inner cover. The radiant barrier is the insulation system of the thermal foot cover, which reflects the wearer's body heat back inside the footwear and keeps the wearer's feet warm. The thermal foot cover is flexible, lightweight and readily washable due to the use of the radiant barrier as the insulation system. The addition of a cavity enlargement means and a means for fastening the cavity enlargement means can be used to facilitate the insertion of the wearer's shoe-encased or boot-encased foot or the wearer's foot into the thermal foot cover and facilitate securing of the thermal foot cover to the wearer's shoe-encased or boot-encased foot or the wearer's foot and ankle to prevent loss of body heat when the thermal foot cover is being worn. A coating may be added to bottom of the thermal foot cover to provide a non-skid surface for walking. A flexible sole may also be provided for increased durability.

7 Claims, 6 Drawing Sheets

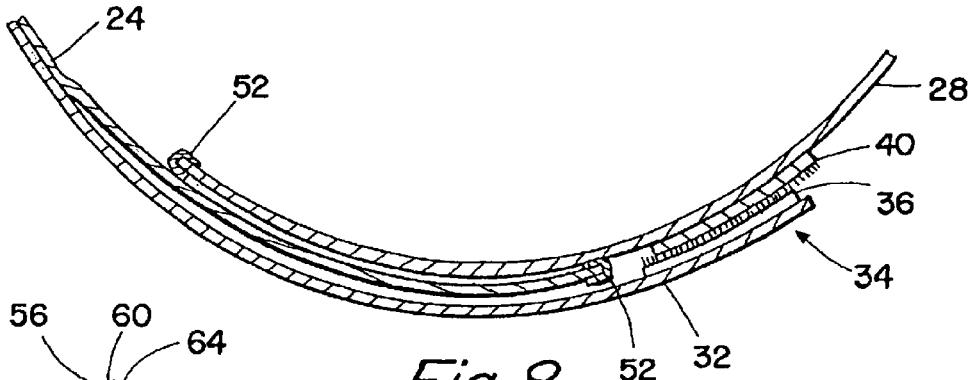
Fig. 8
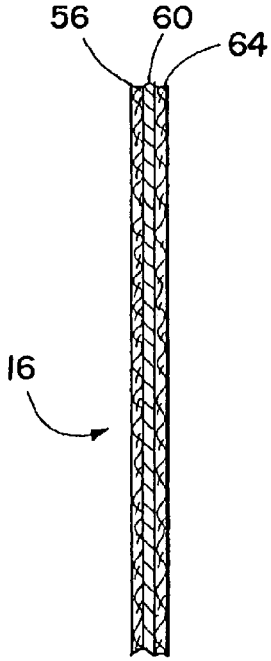
Fig. 9
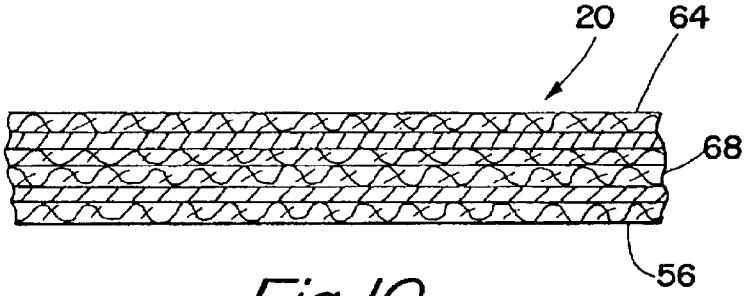
Fig. 10
Fig. 11
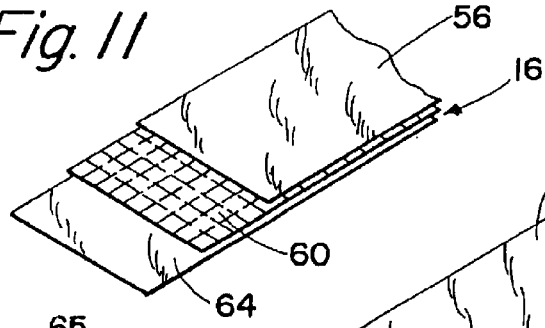
Fig. 11A
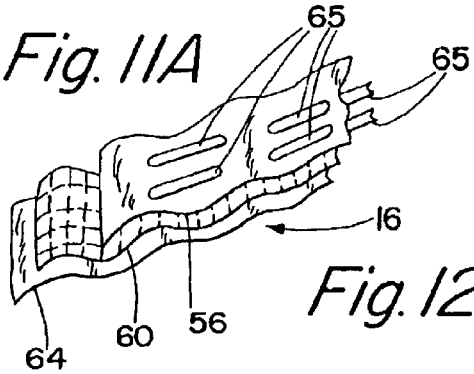
Fig. 12
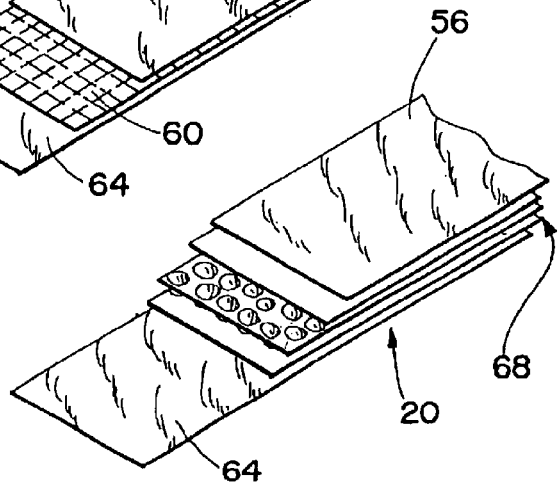

Fig. 13
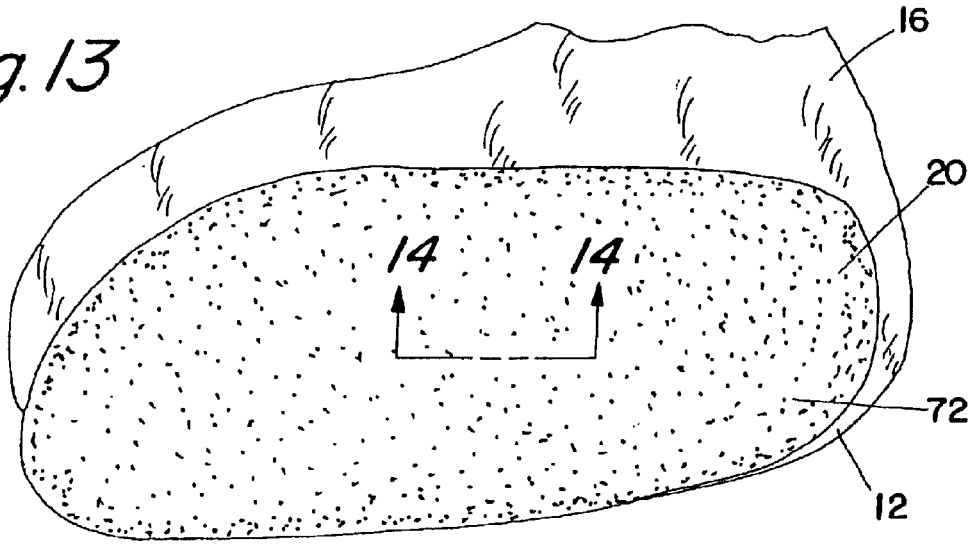
Fig. 14
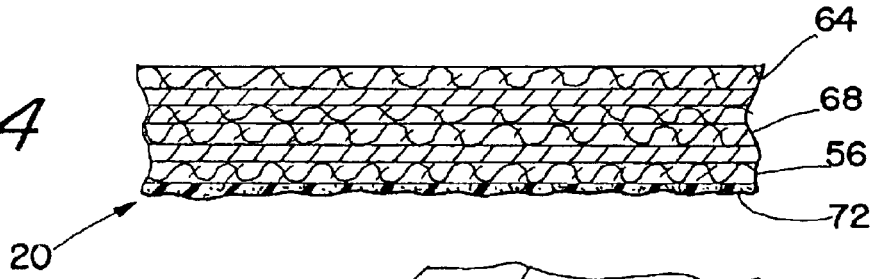
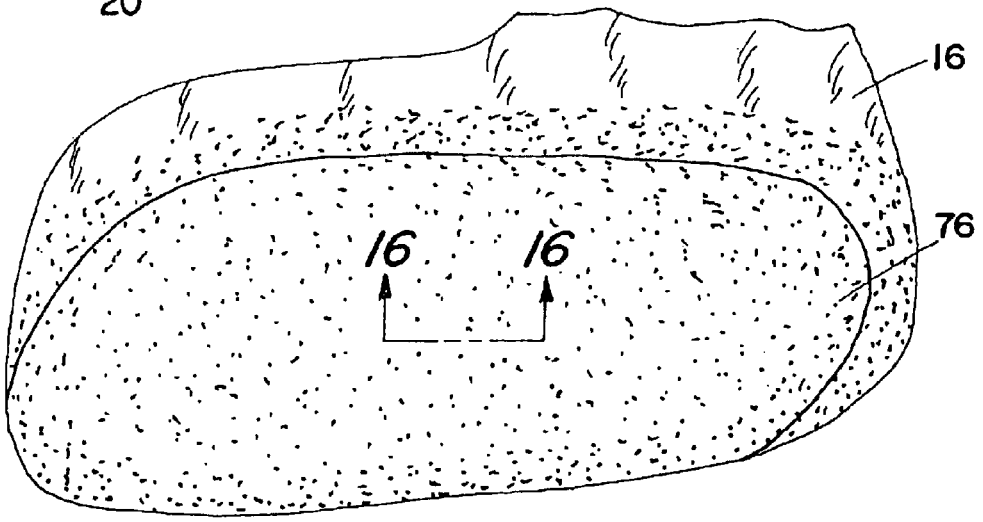
Fig. 15
Fig. 16
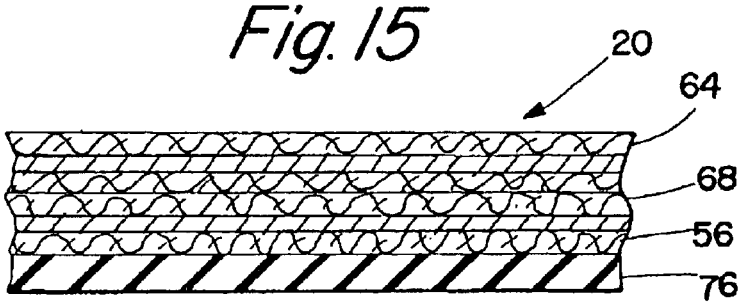

THERMAL FOOT COVER

BACKGROUND

The present invention relates to a thermal foot cover that can be worn over a shoe-encased or a boot-encased foot, or can be worn in place of a shoe or a boot to protect the wearer's foot from the effects of cold temperatures.

The cooling of the extremities, particularly the feet, has long been recognized as a serious deterrent to performing activities in cold temperatures and various proposals have been advanced for dealing with this problem. Most previous footwear, which has been designed for use in cold weather, has utilized hard and heavy materials on the sole and sometimes on the uppers as well. For instance, hard rubber soles are most commonly used for winter boots and overboots. Since such footwear is generally constructed with rigid sole structures, carrying and storing the footwear can be difficult.

Also, previous footwear, designed for use in cold weather, has utilized conventional insulating materials, such as goose down, stiff insulating foam or synthetic fibers, to reduce the loss of heat from the wearer's foot. While these insulating materials attempt to minimize the heat loss from the wearer's foot, none of these insulating materials reflect the wearer's body heat back inside the footwear. Also, these insulating materials are not readily washable. Another disadvantage of these insulating materials is that they increase the bulk of the footwear, which makes the footwear more difficult to carry and store.

A foot cover that is easy to manufacture, is easy to use, is lightweight, is easy to carry, is easy to store, is washable and is highly effective at keeping the wearer's feet warm would be of considerable value.

SUMMARY

Instead of using conventional insulating materials to slow the loss of body heat that occurs when the wearer's feet are exposed to a cold temperature, the invention provides an insulation system that reflects the wearer's body heat back inside the thermal foot cover to keep the wearer's feet warm for extended periods, even when the temperature on the outside of the thermal foot cover is very cold. The invention is flexible, lightweight, easy to carry, easy to store and readily washable due to the material used in the construction of the thermal foot cover.

In one embodiment of the invention, a thermal foot cover comprises an upper cover portion, a bottom panel, a cavity enlargement means and a means for fastening the cavity enlargement means. The upper cover portion is comprised of an outer covering, a radiant barrier, and an inner covering. The radiant barrier comprises two thin sheets of aluminum foil, extruded polymer, and a reinforcing scrim. The extruded polymer and the reinforcing scrim are sandwiched between the two sheets of aluminum foil to form the radiant barrier. The radiant barrier provides an insulation system that is flexible, lightweight, water-resistant and washable. The radiant barrier reflects the heat from the wearer's foot back inside the thermal foot cover to keep the wearer's foot warm even when temperatures on the outside of the thermal foot cover are very cold.

The bottom panel is attached to the upper cover portion to form the bottom of the thermal foot cover. The combination of the upper cover portion and the bottom panel define a cavity for receiving a shoe-encased or boot-encased foot or only the wearer's foot inside the thermal foot cover. The bottom panel comprises an outer covering, a radiant bubble barrier and an inner covering. The radiant bubble barrier comprises two thin sheets of aluminum foil and two sheets of polymeric material with a plurality of air-bubbles between the polymeric sheets. The two polymeric sheets with the plurality of air bubbles between the polymeric sheets are sandwiched between the two sheets of aluminum foil. The air trapped between the two sheets of polymeric material and the two sheets of aluminum foil in the radiant bubble barrier, used in the bottom panel, enhance the insulating effectiveness of the bottom panel. The radiant bubble barrier also provides padding to the bottom panel to increase the comfort of wearing the thermal foot cover. The radiant bubble barrier provides an insulation system that is flexible, lightweight, water-resistant and washable.

The cavity enlargement means and the means for fastening the cavity enlargement means are attached to the upper cover portion such that they cooperate with the upper cover portion to provide a larger opening for receiving a shoe-encased or boot-encased foot, or only the wearer's foot inside the thermal foot cover and to close up the opening, once the shoe-encased or boot-encased foot or the wearer's foot is received inside the cavity of the thermal foot cover, to prevent the wearer's body heat from escaping from the thermal foot cover.

It is the object of the invention to provide a thermal foot cover that reflects the wearer's body heat back inside the thermal foot cover to increase the effectiveness of keeping the wearer's feet warm when encased by the thermal foot cover. Reflecting the wearer's heat back into the thermal foot cover is accomplished in a novel way by using a radiant barrier or a combination of a radiant barrier and a radiant bubble barrier instead of using normal insulating materials.

It is the object of the invention to provide a thermal foot cover that is easy to manufacture and can be manufactured at a low cost.

It is another object of the invention to provide a thermal foot cover that is of a one piece design that is effective and is simple to use.

It is still another object of the invention to provide a thermal foot cover that is lightweight and can be stored in a small space and is easy to carry.

It is still another object of the invention to provide a thermal foot cover that accommodates a wide range of footwear sizes and arrangements.

It is still another object of the invention to provide a thermal foot cover that has a bottom panel exterior coating that provides a non-slip surface on the bottom of the thermal foot cover.

It is yet another object of the invention to provide a thermal foot cover that has a separate sole attached to the bottom panel, to the lower part of the first side panel and to the lower part of the second side panel to allow the wearer to walk over varied terrain without damaging the thermal foot cover.

Still yet, another object of the invention is to provide a new and improved thermal foot cover which provides some of the advantages found in the apparatuses and methods of the prior art thereof, while simultaneously overcoming some of the disadvantages normally associated therewith.

BRIEF DESCRIPTION OF THE DRAWINGS

These and other features, aspects, and advantages of the present invention will become better understood with respect to the following description and accompanying drawings where:

FIG. 8 is a sectional view of the invention taken along the line 8—8 of FIG. 2;

FIG. 9 is a sectional view of the invention taken along the line 9—9 of FIG. 2;

FIG. 10 is a sectional view of the invention taken along the line 10—10 of FIG. 7;

FIG. 11 is an isometric perspective sectional view of the invention taken from the area shown on FIG. 1;

FIG. 11A is an isometric perspective sectional view of the ankle portion of the invention taken from the area shown on FIG. 1;

FIG. 12 is an isometric perspective sectional view of the invention taken from the area shown on FIG. 7;

FIG. 13 is an isometric perspective bottom view of a second embodiment of the invention comprising a bottom panel exterior coating on the exterior of the bottom panel;

FIG. 14 is a sectional view of the second embodiment of the invention taken along the line 14—14 of FIG. 13;

FIG. 15 is an isometric perspective bottom view of a third embodiment of the invention comprising a separate sole attached to the bottom panel, the lower part of the first side panel and the lower part of the second side panel;

FIG. 16 is a sectional view of the third embodiment of the invention taken along the line 16—16 of FIG. 15;

DESCRIPTION

Figure 1:
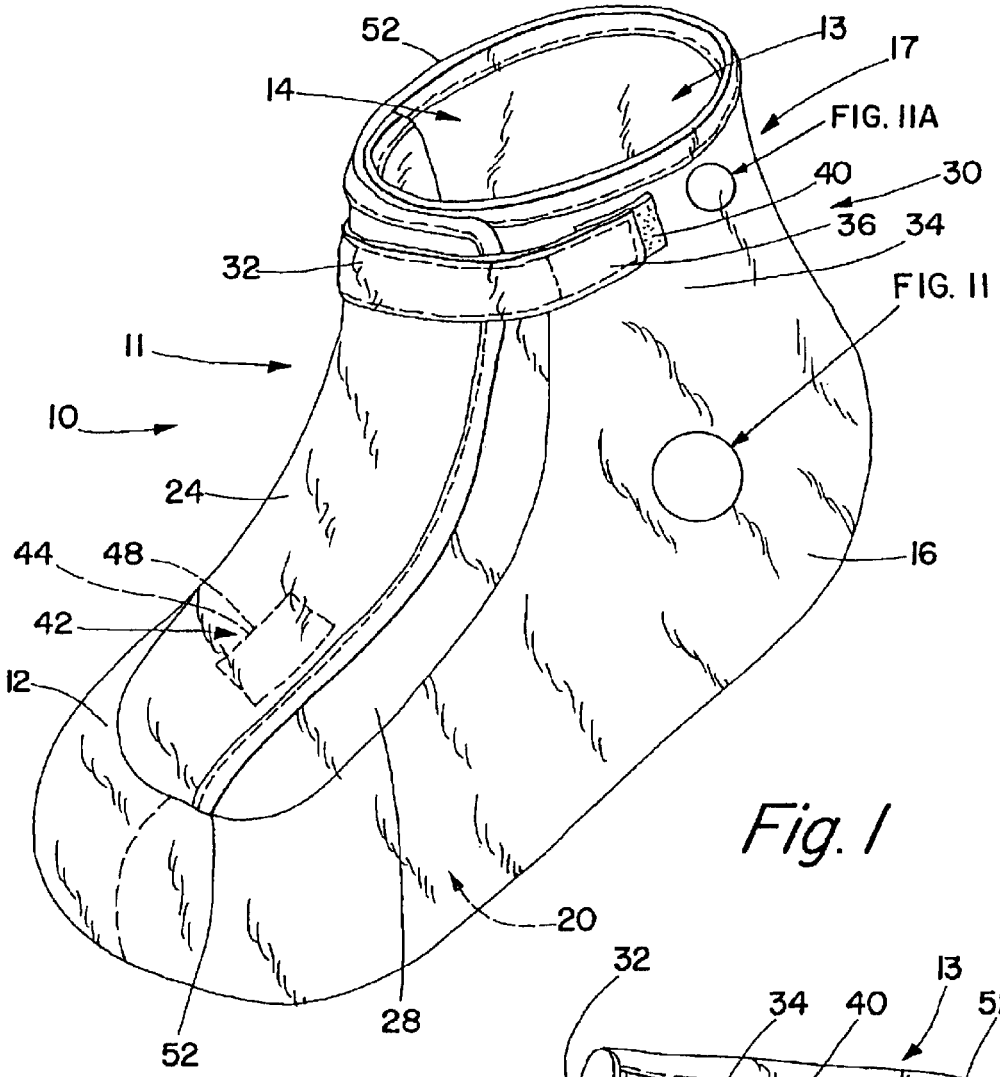
FIG. 1 is an isometric perspective view of one embodiment of the invention.
Figure 6:
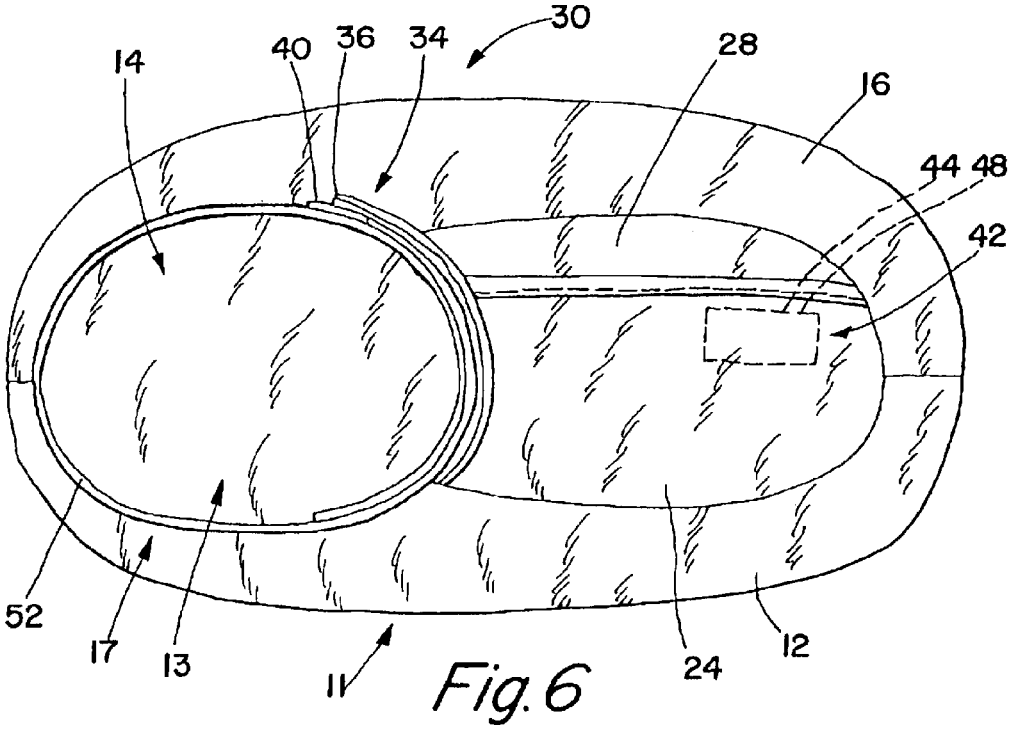
FIG. 6 is a top perspective view of the invention shown in FIG. 1.
Figure 7:
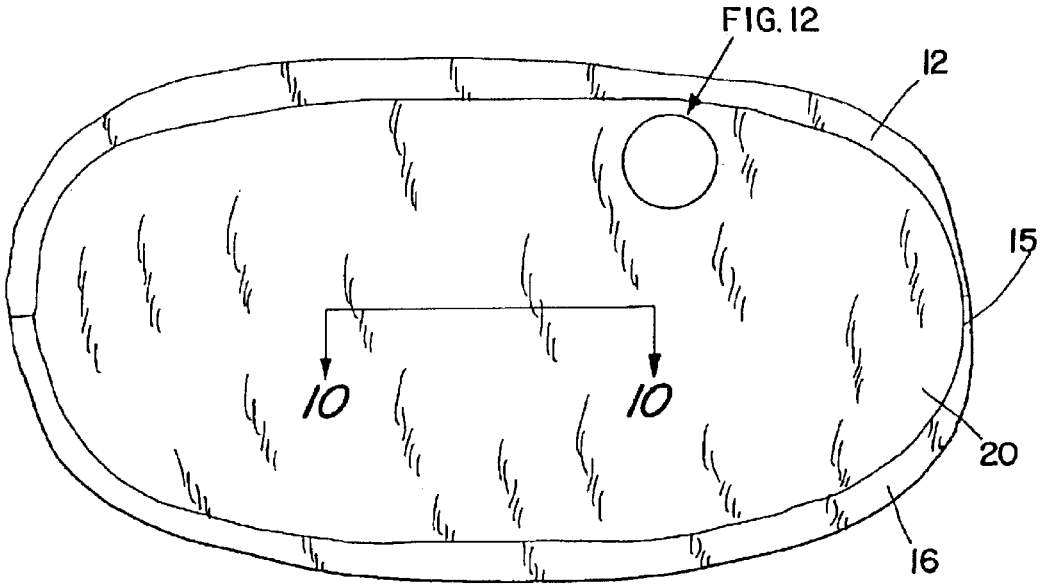
FIG. 7 is a bottom perspective view of the invention shown in FIG. 1.
Figure 17:
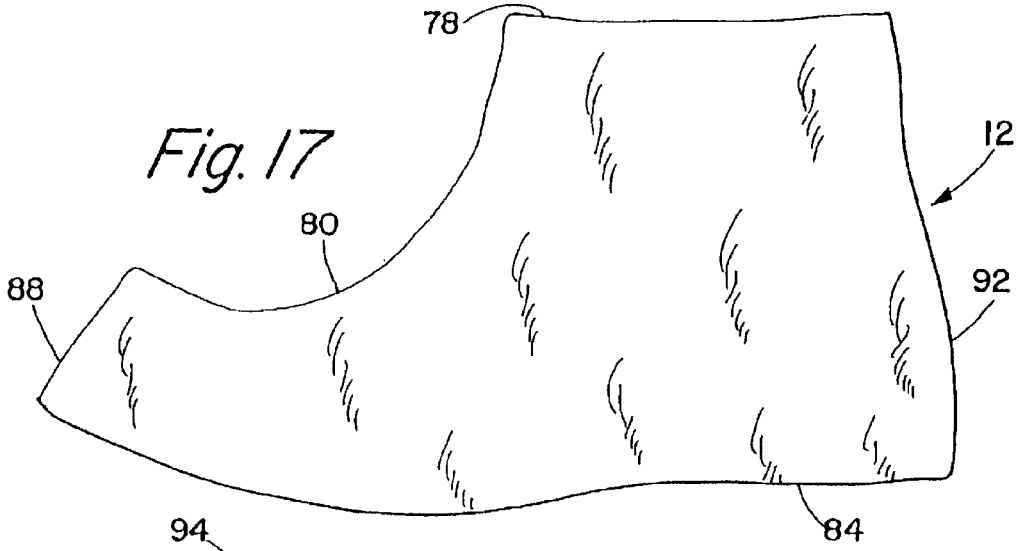
FIG. 17 is a side view of the first side panel shown in FIG. 1.
Figure 18:
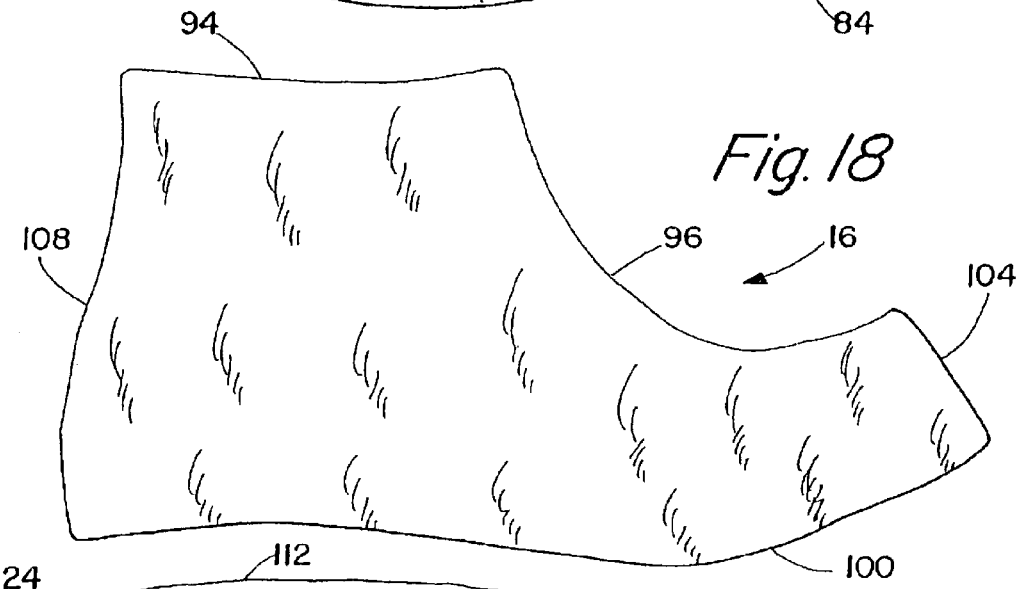
FIG. 18 is a side view of the second side panel shown in FIG. 1.
Figure 19:
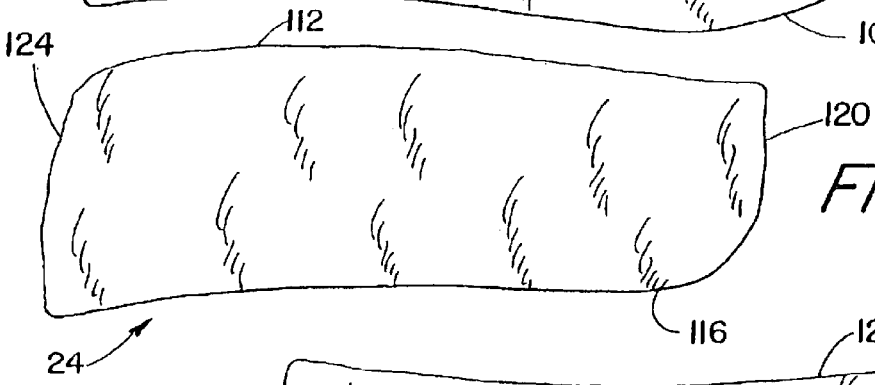
FIG. 19 is a side view of the first top panel shown in FIG. 1.
Figure 20:
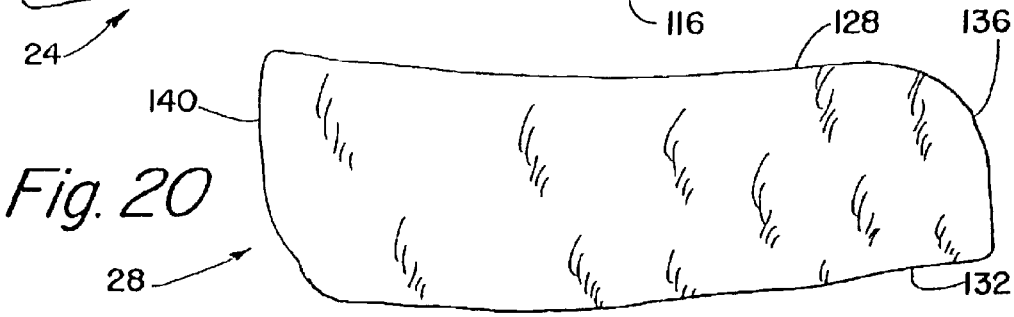
FIG. 20 is a side view of the second top panel shown in FIG. 1.

Referring to the figures of the drawings, wherein like numerals of reference designate like elements throughout the several views, particularly to FIG. 1, there is shown a thermal foot cover 10 for receiving a shoe-encased or boot-encased foot, or a wearer's foot in order to keep the wearer's foot warm when the wearer is subjected to cold temperatures. As shown in FIG. 1, FIG. 6 and FIG. 7, the thermal foot cover 10 comprises an upper cover portion 11 and a bottom panel 20, defining a cavity 13 for receiving a shoe-encased or boot-encased foot or a wearer's foot. An opening 14 allows insertion of the shoe-encased or a boot-encased foot or the wearer's foot inside the thermal foot cover 10. In one embodiment, the upper cover portion 11 is attached to the bottom panel 20 at attachment seam 15 of FIG. 7 by sewing or gluing. The upper cover portion 11 comprises an outer covering 56 and, in at least a portion of the upper cover portion 11, a radiant barrier 60. The bottom panel 20 comprises an outer covering 56 only. The outer covering 56 used in the upper cover portion 11 and the bottom panel 20 is a thin sheet of material made from textiles, flexible polymeric material, animal skins or a combination of these materials in a variety of colors. The radiant barrier 60, used in at least a portion of the upper cover portion 11, is attached to the inside of the outer covering 56. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the, two sheets of aluminum foil to form the radiant barrier 60. The preferred radiant barrier 60 provides an insulation system that is flexible, lightweight, water-resistant and washable. The radiant barrier 60 reflects the heat from a wearer's foot back inside the thermal foot cover 10 to keep the wearer's foot warm even when temperatures on the outside of the thermal foot cover 10 are very cold.

In another embodiment of the thermal foot cover 10, the upper cover portion 11 is attached to the bottom panel 20 at attachment seam 15 of FIG. 7 by sewing or gluing. The upper cover portion 11 comprises an outer covering 56 only. The bottom panel 20 comprises an outer covering 56 and a radiant barrier. The radiant barrier 60, used in the bottom panel 20, is attached to the inside of the outer covering 56. The outer covering 56 used in the upper cover portion 11 and the bottom panel 20 is a thin sheet of material made from textiles, flexible polymeric material, animal skins or a combination of these materials in a variety of colors. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

In another embodiment of the thermal foot cover 10, the thermal foot cover 10 comprises an upper cover portion 11 and a bottom panel 20. The upper cover portion 11 is attached to the bottom panel 20 at attachment seam 15 of FIG. 7 by sewing or gluing. The upper cover portion 11 comprises an upper cover portion 11 and a radiant barrier 60. The bottom panel 20 comprises an outer covering 56 and a radiant barrier 60. The outer covering 56 used in the upper cover portion 11 and the bottom panel 20 is a thin sheet of material made from textiles, flexible polymeric material, animal skins or a combination of these materials in a variety of colors. The radiant barrier used in the upper cover portion 11 and the bottom panel 20 is attached to the inside of the outer covering 56. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

In another embodiment, the thermal foot cover 10 comprises an upper cover portion 11 and a bottom panel 20. The upper cover portion 11 is attached to the bottom panel 20 at attachment seam 15 of FIG. 7 by sewing or gluing. The upper cover portion 11 comprises a radiant barrier 60 sandwiched between an outer covering 56 and an inner covering 64 as shown in FIG. 11. The bottom panel 20 comprises an outer covering 56 and an inner covering 64. The outer covering 56 and the inner covering 64 used in the upper cover portion 11 and the bottom panel 20 is a thin sheet of material made from textiles, flexible polymeric material, animal skins or a combination of these materials in a variety of colors. The radiant barrier 60 used in the upper portion 11 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

In another embodiment, the thermal foot cover 10 comprises an upper cover portion 11 and a bottom panel 20. The upper cover portion 11 is attached to the bottom panel 20 at attachment seam 15 of FIG. 7 by sewing or gluing. The upper cover portion 11 comprises a radiant barrier 60 sandwiched between an outer covering 56 and an inner covering 64 as shown in FIG. 11. The bottom panel 20 comprises a radiant barrier 60 sandwiched between an outer covering 56 and an inner covering 64 as shown in FIG. 11. The outer covering 56 and the inner covering 64 used in the upper cover portion 11 and the bottom panel 20 is a thin sheet of material made from textiles, flexible polymeric material, animal skins or a combination of these materials in a variety of colors. The radiant barrier 60 used in the upper portion 11 and the bottom panel 20 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60.

In yet another embodiment of the thermal foot cover 10, the thermal foot cover 10 comprises an upper cover portion 11 and a bottom panel 20. The upper cover portion 11 is attached to the bottom panel 20 at attachment seam 15 of FIG. 7 by sewing or gluing. The upper cover portion 11 comprises a radiant bubble barrier 68 sandwiched between an outer covering 56 and an inner covering 64 as shown in FIG. 12. The bottom panel 20 comprises a radiant bubble barrier 68 sandwiched between an outer covering 56 and an inner covering 64 as shown in FIG. 12. The outer covering 56 and the inner covering 64 used in the upper cover portion 11 and the bottom panel 20 is a thin sheet of material made from textiles, flexible polymeric material, animal skins or a combination of these materials in a variety of colors. The radiant bubble barrier 68 can be made from a variety of materials such as metal foil, metallized textiles or metallized flexible polymeric material combined with a sheet of bubble-pack type material. The preferred radiant bubble barrier 68 comprises two sheets of thin aluminum foil and two sheets of polymeric material with a plurality of air bubbles between the polymeric sheets. The two polymeric sheets with the plurality of air bubbles between the polymeric sheets are sandwiched between the two sheets of aluminum foil. The radiant bubble barrier 68 traps air between the two aluminum sheets to further enhance the insulating effectiveness of the thermal foot cover 10. The radiant bubble barrier 68 also provides padding to the thermal foot cover 10 to increase the comfort of wearing the thermal foot cover 10. The radiant bubble barrier 68 provides an insulation system that is flexible, lightweight, water-resistant and washable.

In another embodiment, the thermal foot cover 10, as described in the embodiments above, would further comprise a cavity enlargement means 30 comprising a strap 32 which releases and secures a first top panel 24 of the upper cover portion 11 to a second top panel 28 of the upper cover portion 11 as shown in FIG. 1. The cavity enlargement means 30 increases the size of the cavity 13 to facilitate insertion of a shoe-encased or boot-encased foot or a wearer's foot into the thermal foot cover 10, and decreases the size of the cavity 13, once insertion is completed, to provide a tight, secure fit around the shoe-encased or boot-encased foot, or the wearer's foot and ankle, when the cavity enlargement means 30 is secured, to help keep the wearer's body heat from escaping out of the top of the thermal foot cover 10. In another embodiment, the cavity enlargement means 30 comprises an elastic material in the ankle portion of the upper cover portion 11, shown generally as 17. An example of an elastic material in the ankle portion 17 is shown in FIG. 11A. As shown in FIG. 11A, the elastic threads 65 cause the upper cover portion 11 to have a corrugated or gathering effect in the area of the ankle portion 17. The elastic threads 65 allows the ankle portion 17 to expand which enlarges the opening 14 to accommodate the insertion of the shoe-encased or boot-encased foot or the wearer's foot into the thermal boot cover 10. Once the shoe-encased or boot-encased foot or the wearer's foot is received inside the thermal boot cover 10, the elastic threads 65 contracts which causes the ankle portion 17 of the upper cover portion 11 to secure the thermal foot cover 10 to the shoe-encased or boot-encased foot or the wearer's foot and ankle of the wearer to minimize the loss of the wearer's body heat from the top of the thermal foot cover 10.

As shown in FIG. 1 through 7, another embodiment of the thermal foot cover 10 comprises a first side panel 12, a second side panel 16, a bottom panel 20, a first top panel 24, a second top panel 28, a trim element 52, a means for fastening the top panels 42, a cavity enlargement means 30 and a means for fastening the cavity enlargement means 34. As shown in FIG. 1 through FIG. 6, the first side panel 12, the second side panel 16, the first top panel 24, and the second top panel 28 are attached together, preferably by sewing these pieces together, to form the upper cover portion 11 of the thermal foot cover 10. As shown in FIG. 9 and FIG. 11, the first side panel 12, the second side panel 16, the first top panel 24, and the second top panel 28 are comprised of an outer covering 56, a radiant barrier 60, and an inner covering 64. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60. The radiant barrier 60 provides an insulation system that is flexible, lightweight, water-resistant and washable. The radiant barrier 60 reflects the heat from a wearer's foot back inside the thermal foot cover 10 to keep the wearer's foot warm even when temperatures on the outside of the thermal foot cover. 10 are very cold. The outer covering 56 and the inner covering 64 used in the first side panel 12, the second side panel 16, the first top panel 24, and the second top panel 28 is a thin sheet of material made from textiles, flexible polymeric material, animal skins or a combination of these materials in a variety of colors.

As shown in FIG. 1 through FIG. 6, the thermal foot cover 10 can have a trim element 52 that is attached to edges of the first side panel 12, the second side panel 16, the first top panel 24, and the second top panel 28. The trim element 52 covers the exposed edges of the first side panel 12, the second side panel 16, the first top panel 24, and the second top panel 28 to provide an improved appearance for the thermal foot cover 10.

Figure 4:
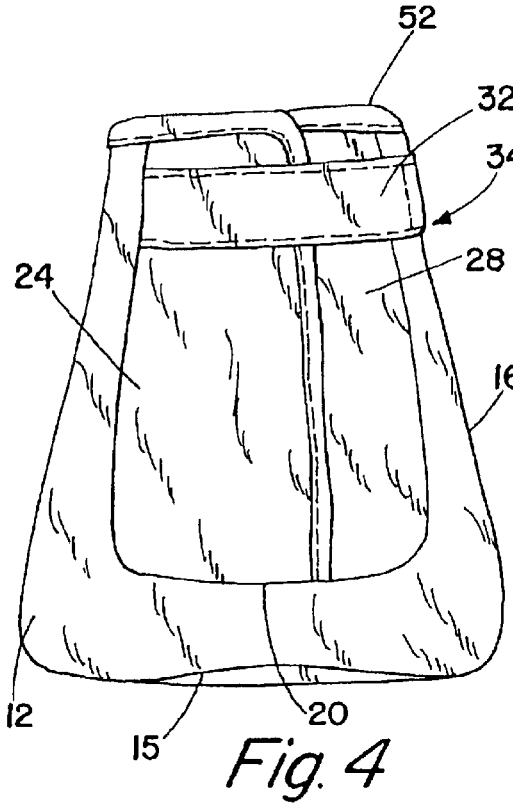
FIG. 4 is a front perspective view of the invention shown in FIG. 1.
Figure 5:
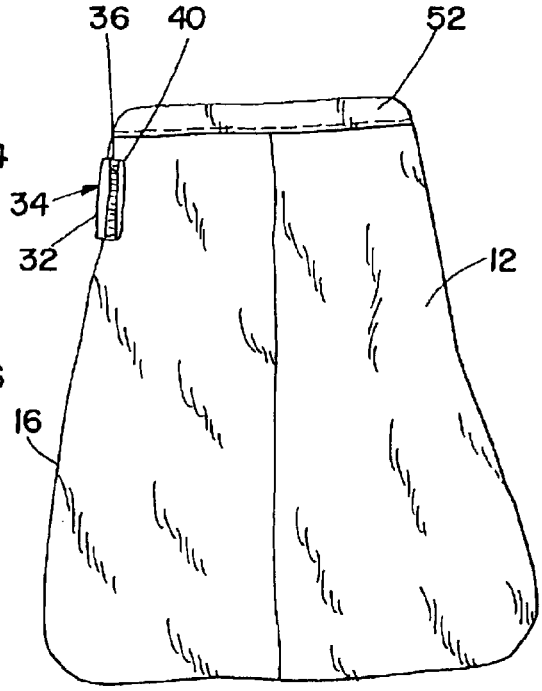
FIG. 5 is a rear perspective view of the invention shown in FIG. 1.

As shown in FIG. 4 and FIG. 7, the bottom panel 20 is attached to the first side panel 12 and the second side panel 16, preferably by sewing these pieces together, to form the bottom of the thermal foot cover 10. As shown in FIG. 10 and FIG. 12, the bottom panel 20 comprises an outer covering 56, a radiant bubble barrier 68 and an inner covering 64. The radiant bubble barrier 68 can be made from a variety of materials such as metal foil, metallized textiles or metallized flexible polymeric material combined with a sheet of bubble-pack type material. The preferred radiant bubble barrier 68 comprises two sheets of thin aluminum foil and two sheets of polymeric material with a plurality of air bubbles between the polymeric sheets. The two polymeric sheets with the plurality of air bubbles between the polymeric sheets are sandwiched between the two sheets of aluminum foil. The radiant bubble barrier 68 traps air between the two aluminum sheets to further enhance the insulating effectiveness of the bottom panel 20. The radiant bubble barrier 68 also provides padding to the bottom panel 20 to increase the comfort of wearing the thermal foot cover 10. The radiant bubble barrier 68 provides an insulation system that is flexible, lightweight, water-resistant and washable. The outer covering 56 and the inner covering 64 used in the bottom panel 20 is a thin sheet of material made from textiles, flexible polymeric material, animal skins or a combination of these materials in a variety of colors.

Figure 3:
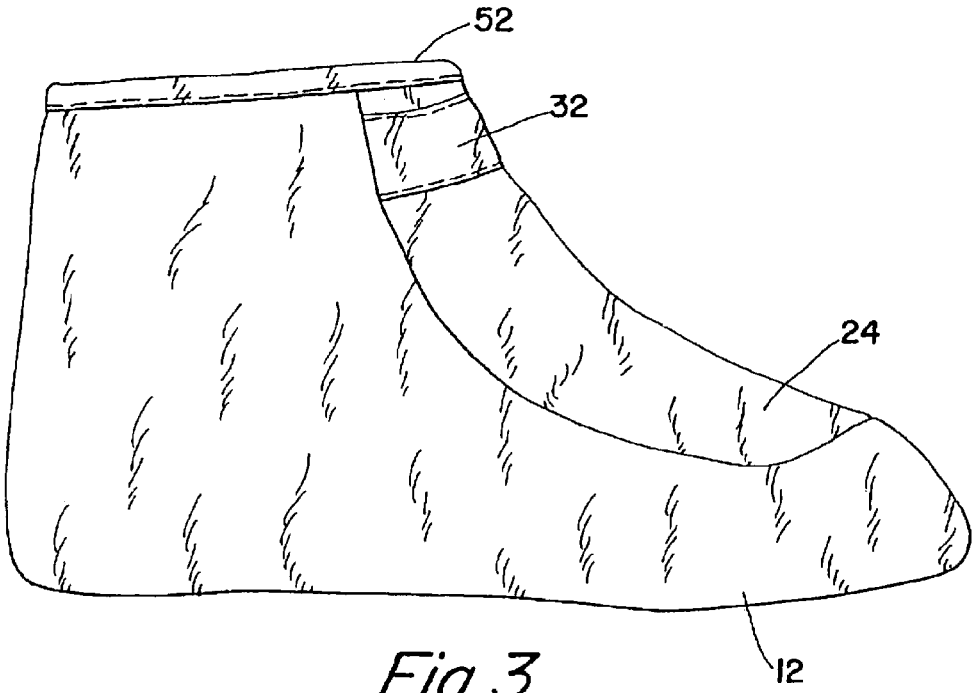
FIG. 3 is an opposite side perspective view of the invention shown in FIG. 1.

As shown in FIG. 3 and FIG. 4, the cavity enlargement means 30 comprising a strap 32 where one end of the strap 32 is attached to the first side panel 12 and the first top panel 24, near the top of the thermal foot cover 10, at the seam where the first side panel 12 and the first top panel 24 are attached together. The strap 32 is of a predetermined length to allow the strap 32 to lay over the top of the first top panel 24, the second top panel 28 and part of the second side panel 16.

The means for fastening the top panels 42 and the cavity enlargement means 30, and the means for fastening the cavity enlargement means 34 are used to facilitate the insertion of the shoe-encased or boot-encased foot or the wearer's foot into the cavity 13 of the thermal foot cover 10 and to provide a tight, secure fit around the shoe-encased or boot-encased foot or the wearer's foot and ankle when secured to prevent the wearer's body heat from escaping from the thermal foot cover 10.

To better illustrate the new and unique features of the present invention, the following will provide a detailed description of different embodiments of the invention. FIG. 1 shows one embodiment of the thermal foot cover 10. In this embodiment, the thermal foot cover 10 comprises a first side panel 12, a second side panel 16, a bottom panel 20, a first top panel 24, a second top panel 28, an opening 14, a trim element 52, a means for fastening the top panels 42, a cavity enlargement means 30 and a means for fastening the cavity enlargement means 34, defining a cavity 13 for receiving a shoe-encased or boot-encased foot or a wearer's foot. The opening 14 allows the insertion of the shoe-encased or boot-encased foot or the wearer's foot into the thermal foot cover 10.

As shown in FIG. 1, FIG. 3, FIG. 4, FIG. 5, FIG. 6, FIG. 9, FIG. 11 and FIG. 17, the first side panel 12 is substantially L-shaped and generally conforms to the shape of a shoe or a boot with a first side panel top straight edge 78, a first-side panel top curved edge 80, a first side panel bottom edge 84, a first side panel front edge 88 and a first side panel rear edge 92. The first side panel comprises an outer covering 56, a radiant barrier 60, and an inner covering 64. The outer covering 56 is a thin sheet of material made from textiles, flexible polymeric material, animal skins or a combination of these materials in a variety of colors. The preferred outer covering 56 material is a cotton cloth that has been treated to be water-resistant. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60. The inner covering 64 is a thin sheet of material made from textiles, flexible polymeric material, animal skins or a combination of these materials in a variety of colors. The preferred inner covering 64 material is a cotton cloth. As shown in FIG. 9 and FIG. 11, the outer covering 56 is attached to one side of the radiant barrier 60 and the inner covering 64 is attached to the opposite side of the radiant barrier 60 thereby sandwiching the radiant barrier 60 between the outer covering 56 and the inner covering 64. The preferred method of attaching the outer covering 56 to the radiant barrier 60 and the inner covering 64 to the radiant barrier 60 is by sewing these three pieces together at one time. The outer covering 56 and the inner covering 64 can also be attached to the radiant barrier 60 by any other conventional means of attachment such as gluing.

As shown in FIG. 1, FIG. 2, FIG. 4, FIG. 5, FIG. 6, FIG. 9, FIG. 11 and FIG. 18, the second side panel 16 is substantially L-shaped and generally conforms to the shape of a shoe or a boot with a second side panel straight top edge 94, a second side panel top curved edge 96, a second side panel bottom edge 100, a second side panel front edge 104 and a second side panel rear edge 108. The second side panel 16 comprises an outer covering 56, a radiant barrier 60, and an inner covering 64. The outer covering 56 is a thin sheet of material made from textiles, flexible polymeric material, animal skins or a combination of these materials in a variety of colors. The preferred outer covering 56 material is a cotton cloth that has been treated to be water-resistant. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60. The inner covering 64 is a thin sheet of material made from textiles, flexible polymeric material, animal skins or a combination of these materials in a variety of colors. The preferred inner covering 64 material is a cotton cloth. As shown in FIG. 9 and FIG. 11, the outer covering 56 is attached to one side of the radiant barrier 60 and the inner covering 64 is attached to the opposite side of the radiant barrier 60 thereby sandwiching the radiant barrier 60 between the outer covering 56 and the inner covering 64. The preferred method of attaching the outer covering 56 to the radiant barrier 60 and the inner covering 64 to the radiant barrier 60 is by sewing these three pieces together at one time. The outer covering 56 and the inner covering 64 can also be attached to the radiant barrier 60 by any other conventional means of attachment such as gluing. As shown in FIG. 1, FIG. 4, FIG. 6, FIG. 17 and FIG.

18, the first side panel front edge 88 is attached to the second side panel front edge 104 to form the toe of the thermal foot cover 10. As shown in FIG. 5, FIG. 6, FIG. 17 and FIG. 18, the first side panel rear edge 92 is attached to the second side panel rear edge 108 to form the heel of the thermal foot cover 10. The preferred method of attaching the edges of the second side panel 16 to the edges of the first side panel 12 is by sewing these edges together. The edges of the second side panel 16 can also be attached to the edges of the first side panel 12 by any other conventional means of attachment such as gluing.

As shown in FIG. 4 and FIG. 7, the bottom panel 20 comprises an outer covering 56, a radiant barrier 60 and an inner covering 60 that is substantially oval in shape. The outer covering 56 is a thin sheet of material made from textiles, flexible polymeric material, animal skins or a combination of these materials in a variety of colors. The preferred outer covering 56 material is a cotton cloth that has been treated to be water-resistant. The radiant barrier 60 can be made from a variety of materials such as metal foil, metallized textiles or metallized flexible polymeric material. The preferred radiant barrier 60 comprises two thin sheets of aluminum foil, extruded polymer, and a reinforcing scrim. The extruded polymer and the reinforcing scrim are sandwiched between the two sheets of aluminum foil to form the radiant barrier 60. The inner covering 64 is a thin sheet of material made from textiles, flexible polymeric material, animal skins or a combination of these materials in a variety of colors. The preferred inner covering 64 material is a cotton cloth. As shown in FIG. 9 and FIG. 11, the outer covering 56 is attached to one side of the radiant barrier 60 and the inner covering 64 is attached to the opposite side of the radiant barrier 60 thereby sandwiching the radiant barrier 60 between the outer covering 56 and the inner covering 64. The preferred method of attaching the outer covering 56 to the radiant barrier 60 and the inner covering 64 to the radiant barrier 60 is by sewing these three items together at one time. The outer covering 56 and the inner covering 64 can also be attached to the radiant barrier 60 by any other conventional means of attachment such as gluing.

As shown in FIG. 10 and FIG. 12, another embodiment of the bottom panel 20 comprises an outer covering 56, a radiant bubble barrier 68 and an inner covering 64 that is substantially oval in shape. The outer covering 56 is a thin sheet of material made from textiles, flexible polymeric material, animal skins or a combination of these materials in a variety of colors. The preferred outer covering 56 material is a cotton cloth that has been treated to be water-resistant. The radiant bubble barrier 68 can be made from a variety of materials such as metal foil, metallized textiles or metallized flexible polymeric material combined with a sheet of bubble-pack type material. The preferred radiant bubble barrier 68 comprises two sheets of thin aluminum foil and two sheets of polymeric material with a plurality of air bubbles between the polymeric sheets. The two polymeric sheets with the plurality of air bubbles between the polymeric sheets are sandwiched between the two sheets of aluminum foil. The inner covering 64 is a thin sheet of material made from textiles, flexible polymeric material, animal skins or a combination of these materials in a variety of colors. The preferred inner covering 64 material is a cotton cloth. As shown in FIG. 12, the outer covering 56 is attached to one side of one of the radiant bubble barrier 68 and the inner covering 64 is attached to the opposite side of the radiant bubble barrier 68 thereby sandwiching the radiant bubble barrier 68 between the outer covering 56 and the inner covering 64. The preferred method of attaching the outer covering 56 to the radiant bubble barrier 68 and the inner covering 64 to the radiant bubble barrier 68 is by sewing these three pieces together at one time. The outer covering 56 and the inner covering 64 can also be attached to the radiant bubble barrier 68 by any other conventional means of attachment such as gluing.

As shown in FIG. 7, the first side panel bottom edge 84 and the second side panel bottom edge 100 are attached to the edge of the bottom panel 20 at seam 15 to form the bottom of the thermal foot cover 10. While the preferred method of attaching the edge of the bottom panel 20 to the first side panel bottom edge 84 and to the second side panel bottom edge 100 is by sewing these pieces together, they can also be attached by any other conventional means of attachment such as gluing.

As shown in FIG. 1, FIG. 3, FIG. 4, FIG. 6 and FIG. 19, the first top panel 24 comprises an outer covering 56, a radiant barrier 60, and an inner covering 64 that is substantially rectangular in shape with a first top panel top edge 112, a first top panel bottom edge 116, a first top panel front edge 120 and a first top panel rear edge 124. The outer covering 56, the radiant barrier 60 and the inner covering 64 used in the first top panel 24 and the method of attaching these three pieces are the same as used in the first side panel 12 and the second side panel 16. As shown in FIG. 1, FIG. 4, FIG. 6, FIG. 17 and FIG. 19, all of the first top panel bottom edge 116 and most of the first top panel front edge 120 are attached to the first side panel top curved edge 80. As shown in FIG. 1, FIG. 4, FIG. 6 and FIG. 19, a small part of the first top panel front edge 120, next to the first top panel top edge 112, is attached to the second side panel top curved edge 96. While the preferred method of attaching the first top panel bottom edge 116 and the first top panel front edge.120 to the first side panel top curved edge 80 and to the second side panel top curved edge 96 is by sewing these pieces together, they can also be attached by any other conventional means of attachment such as gluing.

As shown in FIG. 1, FIG. 2, FIG. 4, FIG. 6 and FIG. 20, the second top panel 28 comprises an outer covering 56, a radiant barrier 60, and an inner covering 64 that is substantially rectangular in shape with a second top panel bottom edge 12B, a second top panel top edge 132, a second top panel front edge 136 and a second top panel rear edge 140. The outer covering 56, the radiant barrier 60 and the inner covering 64 used in the second top panel 28 and the method of attaching these pieces are the same as used in the first side panel 12, the second side panel 16 and the first top panel 24. As shown in FIG. 1, FIG. 4, FIG. 6, FIG. 18 and FIG. 20, all of the second top panel bottom edge 128 and most of the second top panel front edge 136 is attached to the second side panel top curved edge 96. As shown in FIG. 1, FIG. 4 and FIG. 6, a small part of the second top panel front edge 136, next to the second top panel top edge 132, is attached to the first side panel top curved edge 80. The first top panel bottom edge 116, the first top panel front edge 120, the second top panel bottom edge 128 and the second top panel front edge 136 are attached to the first side panel top curved edge 80 and the second side panel top curved edge 96 such that the first top panel 24 overlaps the second top panel 28 to form the top of the thermal foot cover 10. While the preferred method of attaching the second top panel bottom edge 128 and the second top panel front edge 136 to the first side panel top curved edge 80 and to the second side panel top curved edge 96 is by sewing these pieces together, they can also be attached by any other conventional means of attachment such as gluing.

As shown in FIG. 1 through FIG. 6, the thermal foot cover 10 has a trim element 52. The trim element 52 is a thin sheet of material made from textiles, flexible polymeric material, animal skins or a combination of these materials in a variety of colors. The preferred trim element 52 material is a cotton cloth that has been treated to be water-resistant, which is similar to the outer covering 56. The trim element 52 is folded into a U-shape so that the trim element 52 can cover the exposed edges of the first side panel 12, the second side panel 16, the first top panel 24, and the second top panel 28 to provide an improved appearance for the thermal foot cover 10. The trim element 52 is attached to the outer covering 56 and the inner covering 64 along the first side all panel top straight edge 78, along the second side panel top straight edge 94, along the first top panel top edge 112, along the first top panel rear edge 124, along the second top panel top edge 132 and along the second top panel rear edge 140. While the preferred method of attaching the trim element 52 to the first side panel 12, the second side panel 16, the first top panel 24 and the second top panel 28 is by sewing these pieces together, they can also be attached by any other conventional means of attachment such as gluing.

Figure 2:
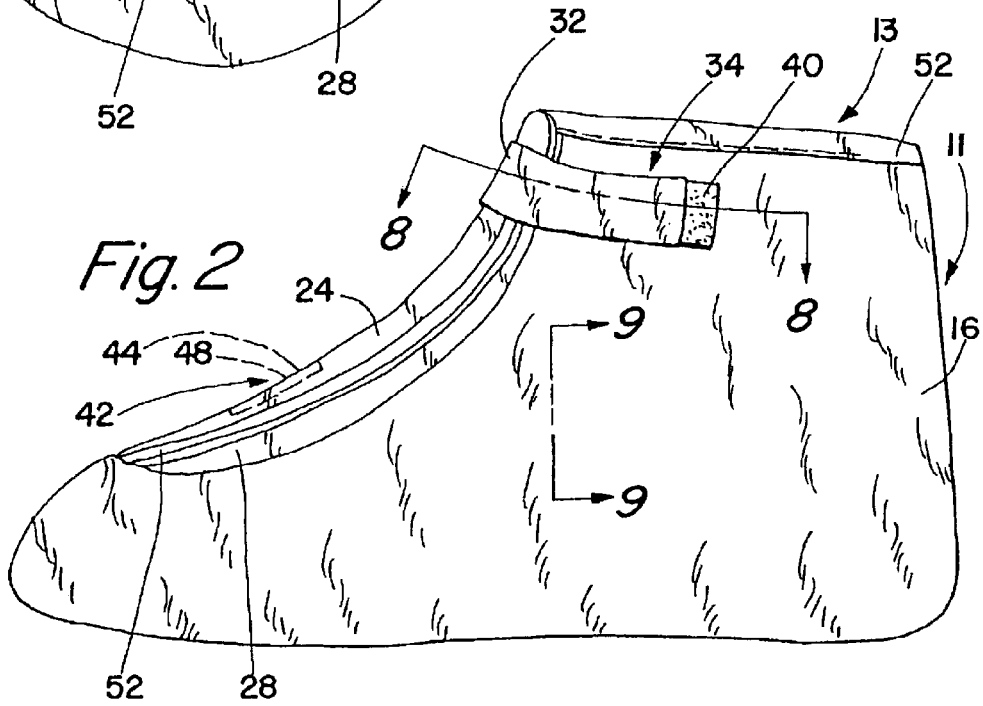
FIG. 2 is a side perspective view of the invention shown in FIG. 1.

As shown in FIG. 1, FIG. 2 and FIG. 6, the first top panel 24 and the second top panel 28 are connected together by a means for fastening the top panels 42. The means for fastening the top panels 42 cooperates with the first top panel 24 and the second top panel 28 to enlarge the cavity 13 to facilitate insertion of a shoe-encased or boot-encased foot or a wearer's foot into the thermal foot cover 10 and provides a tight, secure fit around the shoe-encased or boot-encased foot or the wearer's foot by the first top panel 24 and the second top panel 28 to prevent the loss of the wearer's body heat. In the preferred embodiment of the invention, the means for fastening the top panels 42 comprises a first top panel fastener 44 and a second top panel fastener 48. The first top panel fastener 44 is attached to the inner covering 64 of the first top panel 24. The second top panel fastener 48 is attached to the outer covering 56 of the second top panel 28. The preferred method of attaching the first top panel fastener 44 to the first top panel 24 and of attaching the second top panel fastener 48 to the second top panel 28 is by sewing the fasteners onto the panels. The first top panel fastener 44 and the second top panel fastener 48 can also be attached to the first top panel 24 and the second top panel 28 by any other conventional means of attachment such as gluing. The preferred first top fastener 44 and second top panel fastener 48 are VELCRO hooks and loops fasteners which will allow the first top panel 24 and the second top panel 28 to be held tightly together when the first top panel fastener 44 and the second top panel fastener 48 are fastened, and will allow easy disconnection of the first top panel 24 and the second top panel 28 to enlarge the cavity 13 to facilitate insertion of a shoe-encased or boot-encased foot or a wearer's foot into the thermal foot cover 10 when the first top panel fastener 44 and the second top panel fastener 48 are unfastened. Other means of fastening the top panels 42 include snaps, zippers, and buttons.

As shown in FIG. 1 through FIG. 6, the thermal foot cover 10 has a cavity enlargement means 30. The cavity enlargement means 30 cooperates with the first top panel 24 and the second top panel 28 to enlarge the cavity 13 to facilitate insertion of a shoe-encased or boot-encased foot or a wearer's foot into the thermal foot cover 10 and provides a tight, secure fit around the shoe-encased or boot-encased foot or the wearer's foot and ankle when secured. The preferred cavity enlargement means 30 is a strap 32. The strap 32 comprises an outer covering 56 and an inner covering 64 that is substantially rectangular in shape where the longer sides form the top and bottom of the strap 32 and the shorter sides form the first end and the second end of the strap 32. The outer covering 56 and the inner covering 64 used in the strap 32 are the same as used in the first side panel 12, the second side panel 16, the first top panel 24 and the second top panel 28. The outer covering 56 is attached to the inner covering 64. While the preferred method of attaching the outer covering 56 to the inner covering 64 is by sewing these two pieces together, they can also be attached by any other conventional means of attachment such as gluing. As shown in FIG. 3 and FIG. 4, the first end of the strap 32 is attached to the first side panel 12 and the first top panel 24, near the top of the thermal foot cover 10, at the seam where the first side panel top curved edge 80 and the first top panel bottom edge 116 are attached together. The preferred method of attaching the first end of the strap 32 to the first side panel 12 and the first top panel 24 is by sewing these pieces together, but they can also be attached by any other conventional means of attachment such as gluing. The strap 32 is of a predetermined length to allow the strap 32 to lay over the first top panel 24, the second top panel 28 and part of the second side panel 16.

As shown in FIG. 1 and FIG. 8, a means for fastening the cavity enlargement means 34 cooperates with the cavity enlargement means 30 and the second side panel 16 to allow the cavity enlargement means 30 to hold the first side panel 12, the second side panel 16, the first top panel 24 and the second top panel 28 tightly against the ankle of the wearer when the means for fastening the cavity enlargement means 34 is engaged. As shown in FIG. 1 and FIG. 2, where the cavity enlargement means 30 is a strap 32, the means for fastening the cavity enlargement means 34 comprises a first strap fastener 36 and a second strap fastener 40. As shown in FIG. 1, the first strap fastener 36 is attached to the inner covering 64 of the strap 32, on the second end of the strap 32. As shown in FIG. 1 and FIG. 8, the second strap fastener 40 is attached to the outer covering 56 of the second side panel 16, near the top of the second side panel 16 and near the seam where the second side panel top curved edge 96 and the second top panel bottom edge 128 are attached. The preferred method of attaching the first strap fastener 36 to the strap 32 and of attaching the second strap fastener 40 to the second side panel 16 is by sewing the fasteners onto the strap 32 and the second side panel 16. The first strap fastener 36 and the second strap fastener 40 can also be attached by any other conventional means of attachment such as gluing. The preferred first strap fastener 36 and second strap fastener 40 are VELCRO hooks and loops fasteners, which will allow the strap 32 to hold the first top panel 24, the second top panel 28 and the second side panel 16 tightly together, when the first strap fastener 36 and the second strap fastener 40 are fastened, so that the thermal foot cover 10 will be closed tightly around the ankle of the wearer to prevent heat loss; and will allow easy separation of the first side panel 12, the second side panel 12, the first top panel 24 and the second top panel 28 to enlarge the cavity 13 to receive a shoe-encased or boot-encased foot or a wearer's foot, when the first strap fastener 36 and the second strap fastener 40 are unfastened. Other means of fastening the cavity enlargement means 34 include shoelaces and eyes, ties, clamps, snaps, zippers, and buttons.

An alternative embodiment of the invention is shown in FIG. 12 and FIG. 14, which includes the features discussed above with the addition of a bottom panel exterior coating 72 attached to the outer covering 56 of the bottom panel 20. The bottom panel exterior coating 72 can completely cover the outer covering 56 or can partially cover the outer covering 56 such as comprising a plurality of strips of the bottom panel exterior coating 72 or comprising a plurality of dots of the bottom panel exterior coating 72 attached to the bottom panel 20. The preferred bottom panel exterior coating 72 is a plurality of small polymeric dots attached to the bottom panel 20, which will give the thermal foot cover 10 a non-skid bottom to assist with walking while wearing the thermal foot cover 10.

The thermal foot cover 10 illustrated in FIG. 1 through FIG. 12 is not provided with a separate sole. It has been found that a separate sole on the thermal foot cover 10 is not generally necessary in that prolonged walking is not anticipated while the thermal foot cover 10 is being worn. However, as shown in FIG. 15 and FIG. 16, this embodiment of the thermal foot cover 10 provides for a sole 72 so that the wearer can walk while wearing the thermal foot cover 10. The sole 72 is attached to the bottom part of the first side panel 12, the bottom part of the second side panel 16 and the bottom panel 20. The preferred method of attaching the sole 72 to the first side panel 12, the second side panel 16 and the bottom panel 20 is by gluing the sole 72 to the outer covering 56 of the first side panel 12, the second side panel 16 and the bottom panel 20. The sole 72 may also be attached to the outer covering 56 of the first side panel 12, the second side panel 16 and the bottom panel 20 by any other conventional means of attachment such as sewing. While the sole 72 can be made from any conventional materials, such as animal skins like leather; polymer materials or fabric, the preferred material for the sole 72 is rubber, similar to the rubber used for the sole of a tennis shoe or an athletic shoe, which will make the sole 72 water-resistant and provide additional insulation for the thermal foot cover 10.

In another embodiment of the invention, the sole 72 replaces the bottom panel 20. While the sole 72 can be made of animal skins such as animal skins like leather, polymer materials, or fabric, the preferred sole 72 material is rubber similar to the type found in tennis shoes or athletic shoes because of its water-resistant characteristics.

Although particular embodiments of the invention have been described and illustrated herein, it is recognized that modifications and variations may readily occur to those skilled in the art and consequently it is intended to cover such modifications and equivalents.

I claim:

1. A thermal foot cover for receiving a wearer's shoe-encased or boot-encased foot or a wearer's foot comprising an upper cover portion having an ankle opening therethrough and a bottom panel attached to said upper cover portion to define a cavity for receiving the wearer's shoe-encased or boot-encased foot or wearer's foot, at least a portion of said upper cover portion having an outer covering, an inner covering and a radiant barrier sandwiched between said outer covering and said inner covering, said radiant barrier being adapted to reflect heat inwardly into said cavity, said radiant barrier comprising an inner layer of metal foil overlying said inner covering, adjacent surfaces of said inner covering and said inner layer of metal foil being not bonded to each other, a polymeric sheet bonded to said inner layer of metal foil, an outer layer of metal foil bonded to said polymeric sheet and said outer covering overlying said outer layer of metal foil, adjacent surfaces of said outer covering and said outer layer of metal foil being not bonded to each other.

2. The thermal foot cover of claim 1, at least a portion of said bottom panel having an outer covering, an inner covering and a radiant barrier sandwiched between said outer covering and said inner covering, said bottom panel radiant barrier being adapted to reflect heat inwardly into said cavity.

3. The thermal foot cover of claim 1, said bottom panel being a sole.

4. The thermal foot cover of claim 1, further comprising a cavity enlargement means for facilitating insertion of the wearer's shoe-encased or boot-encased foot or the wearer's foot into said cavity.

5. A thermal foot cover of claim 1, further comprising a bottom panel exterior coating attached to said bottom panel outer covering to provide a non-skid surface on the bottom of the thermal foot cover.

6. The thermal foot cover of claim 4, said upper cover portion comprising a first top panel and a second top panel and said cavity enlargement means comprising a fastener which attached said first top panel to said second top panel to facilitate insertion of the wearer's shoe-encased or boot-encased foot or the wearer's foot into said cavity.

7. The thermal foot cover of claim 4, said cavity enlargement means comprising an expandable ankle portion, said expandable ankle portion being adjacent to said ankle opening and made of an elastic material.

* * * * *